US006986866B2

(12) United States Patent
Gubanich et al.

(10) Patent No.: US 6,986,866 B2
(45) Date of Patent: Jan. 17, 2006

(54) METHOD AND APPARATUS FOR CROSS-HOLE PRESSING TO PRODUCE CUTTING INSERTS

(75) Inventors: Richard J. Gubanich, Delmont, PA (US); Edward M. Dinco, Derry, PA (US)

(73) Assignee: Kennametal Inc., Latrobe, PA (US)

( * ) Notice: Subject to any disclaimer, the term of this patent is extended or adjusted under 35 U.S.C. 154(b) by 183 days.

(21) Appl. No.: 10/287,430

(22) Filed: Nov. 4, 2002

(65) Prior Publication Data

US 2004/0086415 A1 May 6, 2004

(51) Int. Cl.
*B22F 3/02* (2006.01)

(52) U.S. Cl. ..... 419/38; 419/66; 425/78

(58) Field of Classification Search ..... 419/38, 419/66; 425/78; 75/232
See application file for complete search history.

(56) References Cited

U.S. PATENT DOCUMENTS

| | | | | |
|---|---|---|---|---|
| 2,751,293 A | | 6/1956 | Haller | |
| 2,791,804 A | | 5/1957 | Talmage | |
| 3,020,589 A | * | 2/1962 | Maritano | 425/78 |
| 3,346,914 A | * | 10/1967 | Sandstrom et al. | 425/78 |
| 5,032,050 A | | 7/1991 | Niebauer et al. | |
| 5,039,292 A | * | 8/1991 | Tanigawa et al. | 425/78 |
| 5,043,123 A | * | 8/1991 | Gormanns et al. | 264/113 |
| 5,403,373 A | | 4/1995 | Kitagawa et al. | |
| 5,503,795 A | | 4/1996 | Hubbard | |
| 5,710,969 A | | 1/1998 | Newmann | |
| 6,010,283 A | | 1/2000 | Henrich et al. | |
| 6,080,358 A | * | 6/2000 | Oba et al. | 419/5 |
| 6,645,426 B1 | * | 11/2003 | Yoshihara et al. | 419/38 |

FOREIGN PATENT DOCUMENTS

| | | | |
|---|---|---|---|
| EP | 0 718 473 | | 6/1996 |
| GB | 2271526 | | 4/1994 |
| GB | 2271526 A | * | 4/1994 |
| JP | 359197503 A | | 11/1984 |
| JP | HEI 10-118796 | | 5/1998 |
| JP | 2000-71099 | | 3/2000 |

* cited by examiner

*Primary Examiner*—Daniel Jenkins
(74) *Attorney, Agent, or Firm*—John J. Prizzi

(57) ABSTRACT

A method and apparatus for the cross-hole pressing of cutting inserts is disclosed whereby a green part is fabricated using metallurgical powder and an opening is imparted within the green part by placing the metallurgical powder about an oval-shaped core rod. Using a press with a uni-axial press motion, a core rod is placed within the cavity of a mold and metallurgical powder placed around the core rod and thereafter compressed to form a green part. The subject invention is also directed to an article formed utilizing such a process and the uni-axial press used to produce such an insert.

30 Claims, 5 Drawing Sheets

METHOD AND APPARATUS FOR CROSS-HOLE PRESSING TO PRODUCE CUTTING INSERTS

BACKGROUND OF THE INVENTION

1. Field of the Invention

The invention is directed to the field of pressing of powders to make inserts.

2. Description of Related Art

Powder metallurgy has become a viable alternative to traditional casting and machining techniques. In the powder metallurgy process, one or more powder metals and/or ceramics, with or without a fugitive binder, are added to a mold and then compacted under very high pressures, typically between about 20–80 tons per square inch. The compacted part is ejected from the mold as a "green" part. The green part is then sintered in a furnace operating at temperatures of typically 1100°–1950° C. The sintering temperature depends upon the composition of the powder mixture. For example, cemented carbide and cermets are typically sintered at 1350°–1450° C. while ceramics are typically sintered at 1500°–1950° C. The sintering process effectively welds together all of the individual powder grains into a solid mass of considerable mechanical strength with little, if any, porosity. The powder metallurgy process can be generally used to make parts from any type of powder and sintering temperatures are primarily determined by the temperature of fusion of each powder type. Powder metallurgy parts have several significant advantages over traditional cast or machine parts. Powder metallurgy parts can be molded with very intricate features that eliminate much of the grinding that is required with conventional fabrication. Powder metallurgy parts can be molded to tolerances within about four or five thousandths of an inch, a level of precision acceptable for many machined surfaces. Surfaces which require tighter tolerances can be quickly and easily ground since only a small amount of surface material need be removed. Surfaces of powder metallurgy parts are very smooth and offer an excellent finish which is suitable for bearing surfaces.

The powder metallurgy process is also very efficient compared with other processes. Powder metallurgy processes are capable of typically producing between 200–2,000 pieces per hour, depending on the size and of the degree of complexity. The molds are typically capable of thousands of service hours before wearing out and requiring replacement. Since almost all of the powder which enters the mold becomes part of the finished product, the powder metallurgy process is about 97% material efficient. During sintering, it is only necessary to heat the green part to a temperature which permits fusion of the powder granules. This temperature is typically much lower than the melting points of the powders, and so sintering is considerably more energy efficient than a comparable casting process.

In spite of the many advantages of powder metallurgy parts, the fabrication of powder metallurgy parts suffers from certain drawbacks. Powder metallurgy parts are molded under high pressures which are obtained through large opposing forces that are generated by the molding equipment. These forces are applied by mold elements which move back and forth in opposing vertical directions along a pressing axis. The powder metallurgy parts produced thereby have previously necessarily had a "vertical" profile. Since mold elements move back and forth in opposing vertical directions, powder metallurgy parts formed with transverse features, i.e., holes, grooves, undercuts, crosscuts or threads, would inhibit mold release and therefore these features would not be pressed into the green part. Such profile features then required a secondary machining step which added greatly to the cost of the part and creates an economic disincentive to fabricate parts using powder metallurgy.

A method and apparatus are desired capable of effectively imparting a through hole with or without a counterbore through a cutting insert using powder pressing techniques.

SUMMARY OF THE INVENTION

The invention is directed to a method of fabricating an article having an opening using a press with a uni-axial press motion, wherein the article is intended to be sintered and wherein the press has a die with a cavity extending therethrough along a pressing axis. A top ram and a bottom ram are independently movable along the pressing axis within the cavity to define a compression region. The die has a removable core rod insertable within a core bore through the cavity at the compression region in a direction perpendicular to the pressing axis. The method comprises the steps of:

a) positioning the bottom ram within the cavity below the core bore and positioning the top ram outside of the cavity;
b) positioning the removable core rod through the core bore into the cavity;
c) filling the cavity with a predetermined amount of metallurgical powder to form a powder bed having opposing sides;
d) positioning the metallurgical powder about the core rod to control the location of the opening after sintering;
e) moving the top ram down and moving the bottom ram up against the metallurgical powder along the pressing axis to uniformly compress the metallurgical powder about the core rod to produce a green part, wherein the green part has a top and bottom and sides therebetween and the green part has a major axis parallel to the pressing axis with a major width thereacross and also has a minor axis perpendicular to the pressing axis with a minor width thereacross and is formed to be sintered into a cutting insert;
f) retracting the top ram and the bottom ram a predetermined amount to allow decompression of the green part;
g) retracting the core rod from within the cavity; and
h) ejecting the green part from the die.

The invention is also directed to an article having an opening, wherein the article is formed using a uni-axial press motion having a die with a cavity extending therethrough along a pressing axis with a top ram and a bottom ram independently movable along the pressing axis within the cavity to define a compression region and furthermore a removable core rod insertable within a core bore through the cavity at the compression region in a direction perpendicular to the pressing axis, wherein the article is farther formed by the steps described in the previous paragraph.

The invention is further directed to a uni-axial press for forming a green part from metallurgical powder, wherein the press has a die with a cavity extending therethrough along a pressing axis with a top ram and a bottom ram independently movable along the pressing axis within the cavity to define a compression region. A removable core rod is insertable to define a core bore through the cavity at the compression region in a direction perpendicular to the pressing axis, wherein the core rod has a longitudinal axis and comprises a shaft having a non-circular cross-section to impart a non-circular opening within the green part for accommodating shrinkage of the opening when the green part is sintered.

Finally, the invention is directed to an article comprised of compacted metallurgical powder wherein the article has a body with a first lateral wall, an opposing second lateral wall and an adjacent first end wall and opposing second end wall therebetween, wherein the first lateral wall and second lateral wall define an article depth, wherein an opening with a peripheral wall extends about an axis through the depth of the article, wherein a parting line extends about the peripheral wall in a plane perpendicular to the axis, and wherein the article is shaped into a green part to be sintered into a cutting insert.

DETAILED DESCRIPTION OF THE INVENTION

Figure 1:
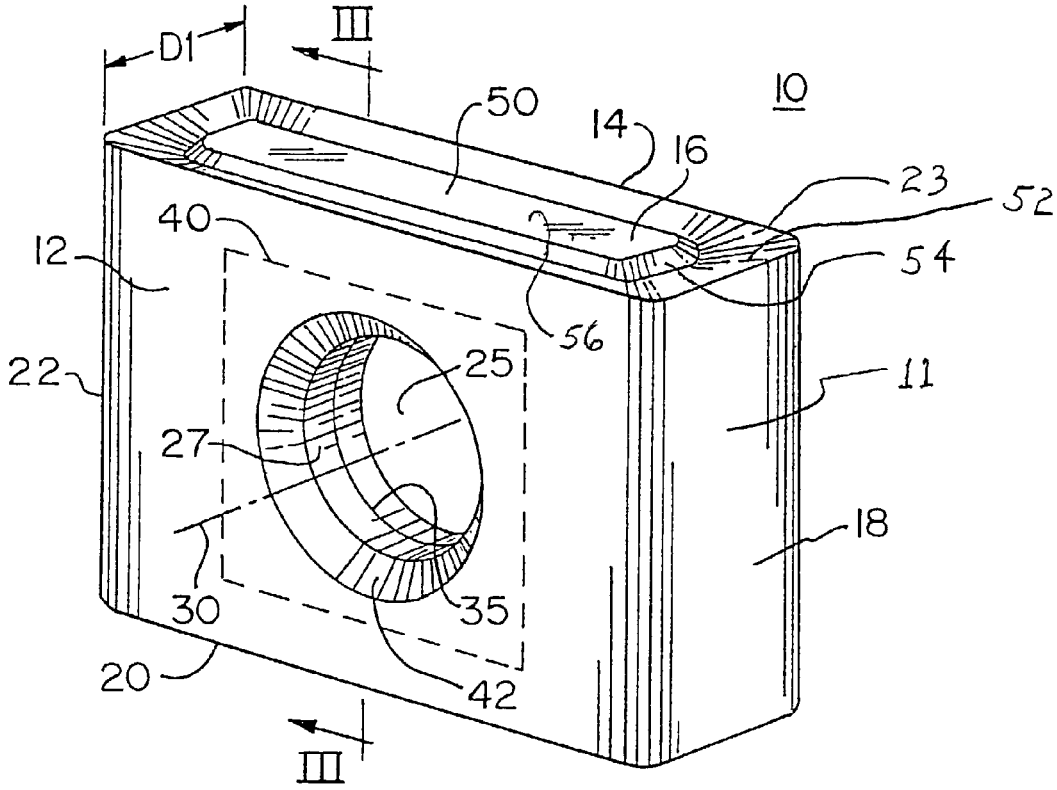
FIG. 1 is an isometric view of a green part fabricated in accordance with the method and apparatus of the subject invention and sintered to form a cutting insert.
Figure 2:
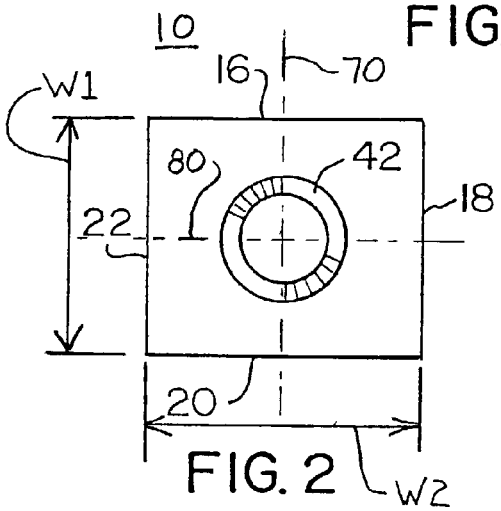
FIG. 2 is a front view of the cutting insert shown in FIG. 1.

FIG. 1 is an isometric view and FIG. 2 is a front view of an article which, in this instance, is a cutting insert 10 after a sintering operation. The cutting insert 10 has a body 11 with a first lateral wall 12, an opposing second lateral wall 14 and an adjacent first end wall 18 and opposing second end wall 22 therebetween. The body has a top 16 and a bottom 20. At the intersection of the walls and the top is a cutting edge 23. The distance D1 between the first lateral wall 12 and the second lateral wall 14 defines the article depth. A central opening 25 with a peripheral wall 27 extends about a central axis 30 through the depth of the insert 10. As a result of the pressing operation to be described herein, a parting line 35 extends about the peripheral wall 27. The parting line 35 may extend about the peripheral wall 27 in a plane 40 perpendicular to the central axis 30. It should be appreciated that while the opening is referred to as a central opening, it is entirely possible that the opening is not centrally located but is offset from the center in one or both the vertical and horizontal direction.

The cutting insert 10 has a major axis 70 parallel to the pressing axis (not shown) of the press with a major width W1 thereacross and has a minor axis 80 perpendicular to the pressing axis with a minor width W2 thereacross.

The cutting insert 10 may have chip control features 50. In one instance, the chip control features 50 may be comprised of a rake face 52 extending downwardly and away from the cutting edge 23 and a plateau wall 54 extending upwardly to a plateau 56 and away from the rake face 52 thereby defining an interrupted path that will promote chip control. These chip control features are generally recessed in a planar region that is perpendicular to the pressing axis of the press to be described. While the discussion has been focused on features upon the top 16 of the green part 110, it should be appreciated that similar or identical features may also exist on the bottom 18 of the green part 110.

What has so far been described is a cutting insert 10 after sintering. Formation of the sintered cutting insert 10 begins with a green part comprised of compressed metallurgical powder which, upon heating to a sintering temperature, densities and shrinks to the size and shape of the cutting insert 10 with or without grind stock left on it. For example, the metallurgical powder may be tungsten carbide powder, cobalt powder and a solid solution carbide forming powder with a fugitive binder mixed in.

As a result of the non-uniformity of compression within the body of the green part, the shrinkage of the green part to the shape of the cutting insert is not uniform. This becomes particularly significant when an opening is present within the insert having an axis in a direction perpendicular to the travel direction of the press rams. In particular, the percentage of shrinkage of the opening during sintering is greater in the direction in which greater compression has occurred. Under certain circumstances, such as when the green part is comprised of cemented tungsten carbide, the shrinkage factor of the opening and the counterbore after sintering is approximately 1.18 in a horizontal direction, which is perpendicular to the pressing axis and 1.22 in a vertical direction, which is parallel to the pressing axis. For this reason, when a circular hole is desired in the cutting insert, the hole in the unsintered green part must be non-circular. It should be noted that under different press pressures, these shrinkage factors may change.

Figure 5:
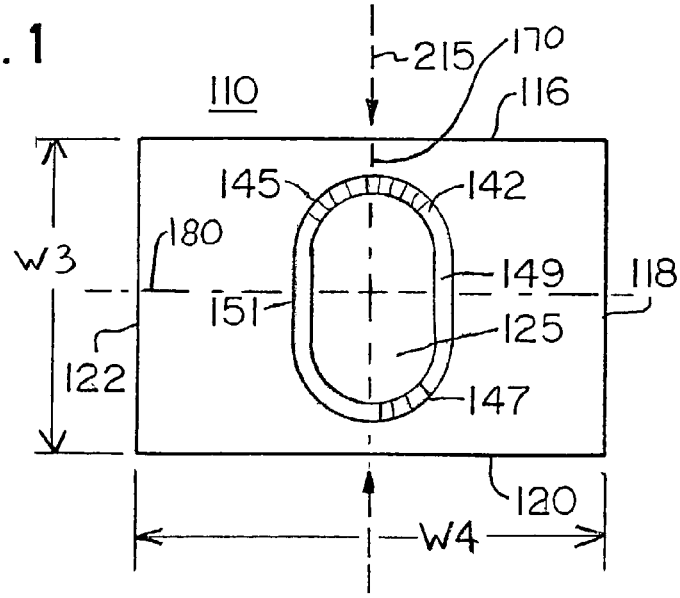
FIG. 5 is a front view of the unsintered green form shown in FIG. 4.
Figure 4:
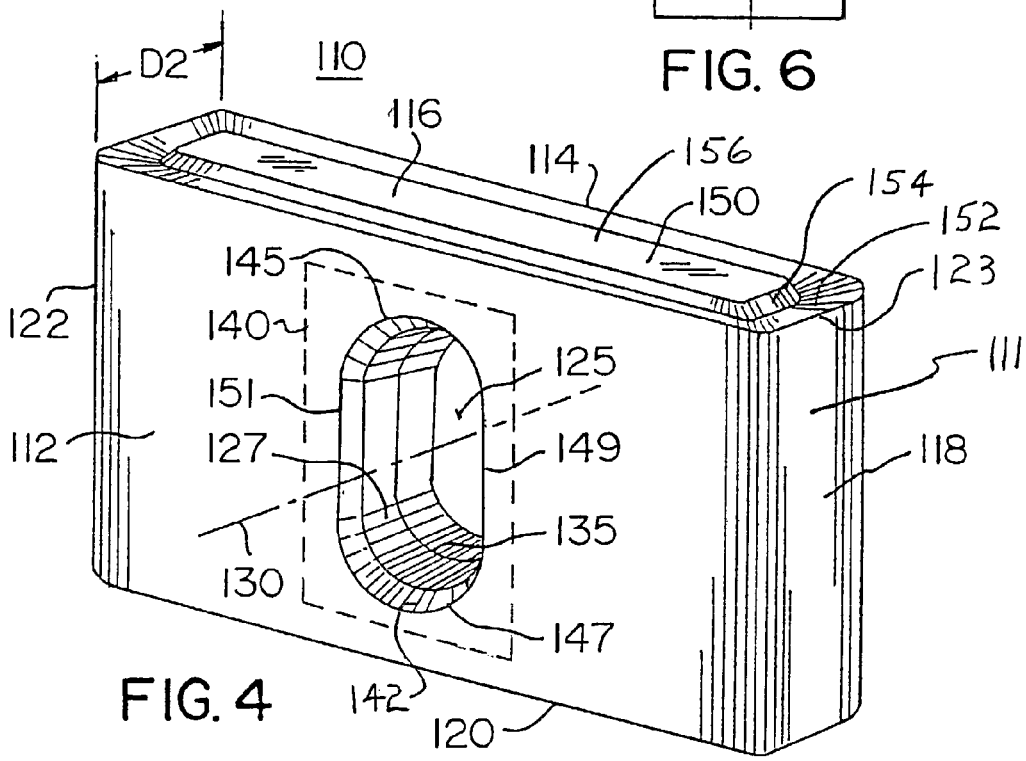
FIG. 4 is an isometric view of an unsintered green part fabricated in accordance with the method and apparatus of the subject invention.

Directing attention to FIGS. 4 and 5, an isometric and a front view of a green part 110 are illustrated prior to sintering to a cutting insert 10 (FIG. 1). For purposes of discussion and unless otherwise specified, the reference numbers used in association with the green part 110 will be the same as those used for the cutting insert 10, but incremented by 100.

The green part 110 has a body 111 with a first lateral wall 112, an opposing second lateral wall 114 and an adjacent first end wall 118 and opposing second end wall 122 therebetween. The body has a top 116 and a bottom 120. At the intersection of the walls 112, 114, 118, 122 and the top is a cutting edge 123. The distance D2 between the first lateral wall 112 and the second lateral wall 114 defines the green part 110 depth. A central opening 125 with a peripheral wall 127 extends about a central axis 130 through the depth D2 of the green part 110. As a result of the pressing operation, a parting line 135 extends about the peripheral wall 127. The parting line 135 may extend about the peripheral wall 127 in a plane 140 perpendicular to the central axis 130.

The green part 110 has a major axis 170 parallel to the pressing axis 215 with a major width W3 thereacross and has a minor axis 180 perpendicular to the pressing axis 215 with a minor width W4 thereacross.

During sintering, the entire green part 110 will shrink and, therefore, the green part 110 must be specifically shaped to account for such shrinkage. The central opening 125, in particular, must be shaped such that, after sintering the opening 125 conforms to a desired final shape. As illustrated in FIG. 1, one such final shape of the central opening 25 is circular.

To provide a central opening 25 having a circular shape, it is necessary for the central opening 125 of the green part 110 to have a non-circular shape. As illustrated in FIGS. 4 and 5, that non-circular shape of the central opening 125 may be oval and, more particularly, may be in the shape of an oval racetrack having a first end 145 and a second end 147 with semi-circular shapes, which connect with a first side 149 and a second side 151 having generally straight profiles. Such an arrangement has been shown to produce, after sintering, a central opening 125 having a circular shape.

Figure 3:
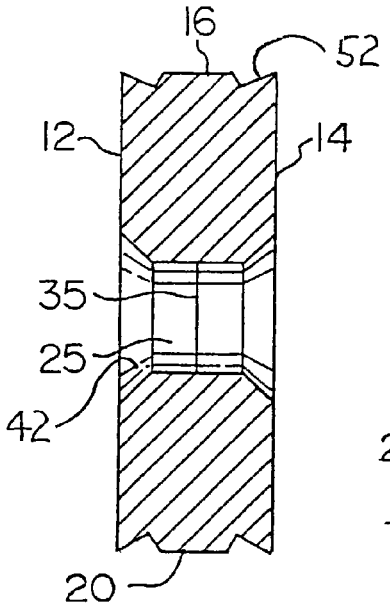
FIG. 3 is a sectional view along lines "III—III" in FIG. 1.

As illustrated in FIGS. 1–3, the cutting insert 10 has a central opening 25 with a beveled counterbore 42. The beveled counterbore 42 conforms to the shape of the central opening 25 and, as a result, the counterbore 142 (FIG. 5) of the green part 110 should be formed to a shape similar to the oval shaped central opening 125.

What has so far been described is a cutting insert 10 having a central opening 25 in the shape of a circle which is formed by sintering a green part 110 having a central opening 125 in the shape of an oval. In some instances the opening 25 (FIG. 1) in the sintered cutting insert may not need to be circular or, as previously mentioned, may not need to be centrally located. Under those circumstances it should be appreciated that the green part will be formed accordingly. The press for producing such a green part, and the method of utilizing such a press, will now be described.

Figure 6:
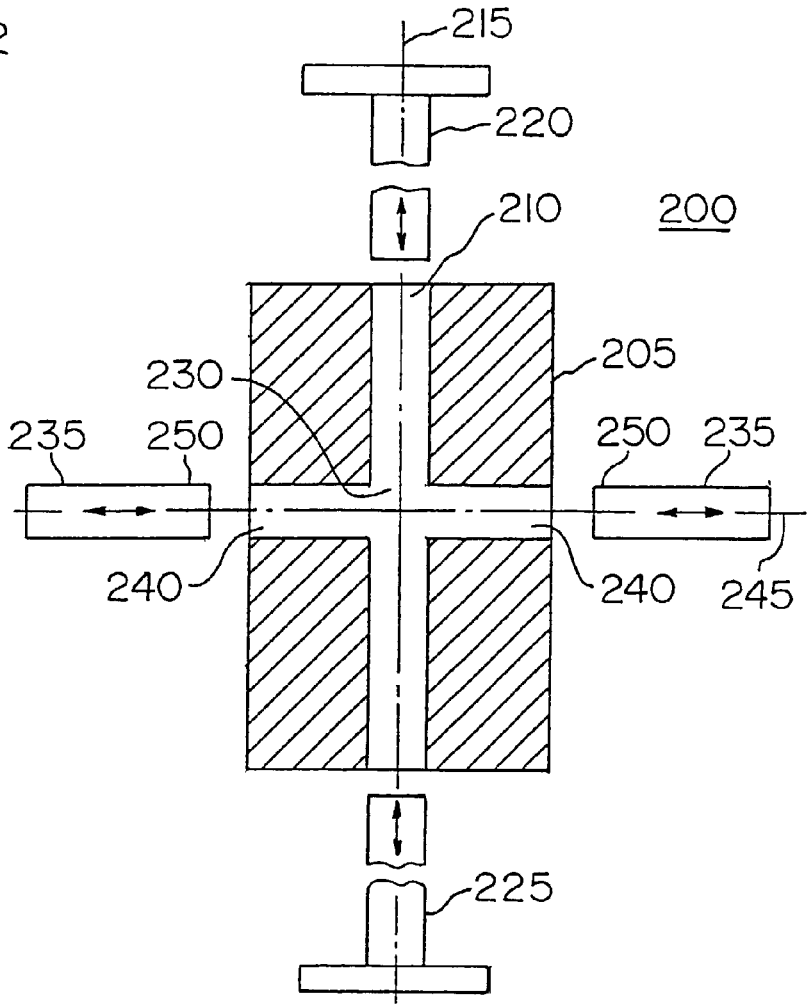
FIG. 6 is a schematic of the parts of a die press in accordance with the subject invention.

FIG. 6 illustrates a cross-sectional sketch of a press 200 used to produce a green part in accordance with the subject invention. The press 200 has a die 205 with a cavity 210 extending therethrough along the pressing axis 215 with a top ram 220 and a bottom ram 225 independently movable within the cavity to define a compression region 230. A removable core rod 235 is insertable within a core bore 240 through the cavity 210 at the compression region 230 in a direction perpendicular to the pressing axis 215. The core rod 235 has its own longitudinal axis 245 transverse to the pressing axis 215. The core rod 235 is comprised of a shaft 250 having a non-circular cross-section (not shown in FIG. 6) to impart a non-circular hole within the green part 110 (FIG. 5).

Figure 7A:
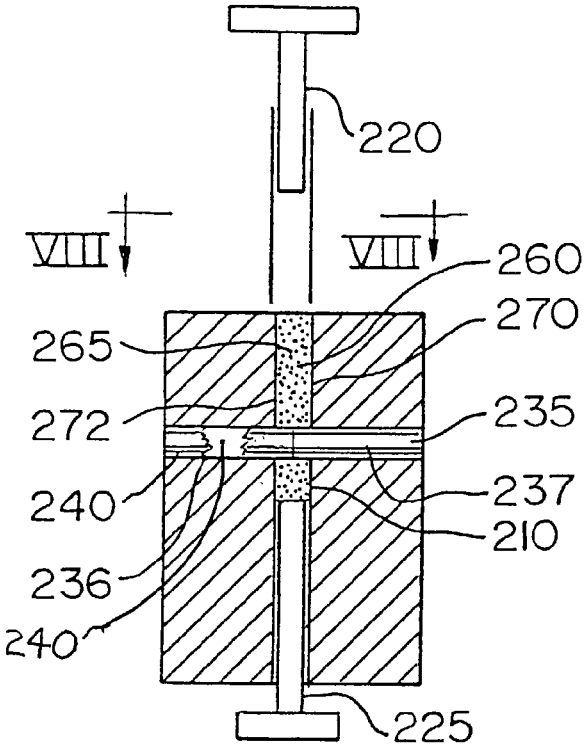
FIGS. 7A–7F illustrate the sequence of die part positions to form a green part in accordance with the subject invention.

FIGS. 7A–7F illustrate the steps in accordance with one embodiment of the subject invention for fabricating a green part 110. In particular, FIG. 7A illustrates one step associated with the method of fabricating an article similar to the green part 110 shown in FIG. 5 having a central opening 125. The article is fabricated using a press with a uni-axial press motion.

In FIG. 7A, the bottom ram 225 is positioned within the cavity 210 below the core bore 240, while the top ram 220 is positioned outside of the cavity 210. The removable core rod 235 is then positioned through the core bore 240 of the cavity 210. The cavity 210 is then filled with a predetermined amount of metallurgical powder 260 to form a powder bed 265 having opposite sides 270, 272. The metallurgical powder 260 is positioned about the core rod 235 to control the location of the central opening 25 (FIG. 1) after sintering. The position of the powder 260 is obtained through the elevation of the bottom ram 225 and/or the movement of the die 205 up or down. Generally the powder 260 will be positioned such that the opening 25 (FIG. 1), after sintering, will be at the geometric center of the cutting insert. However, when desired, the opening 25 may be offset above, below or to the side of the geometric center by placement of the powder 260, or to the side of the geometric center, or by displacement of the core rod 235 to an offset position, by changing the die so the axis of the bore of the core rod is offset from the pressing axis.

Figure 7B:
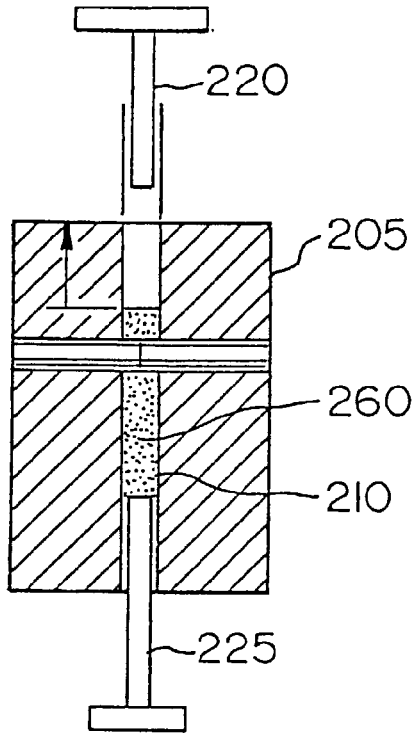

Directing attention to FIG. 7B, subsequent to the step of filling the cavity 210 with metallurgical powder 260, the die 205 is moved up and down relative to the top ram 220 and the bottom ram 225 to substantially uniformly distribute the metallurgical powder 260 within the cavity 210.

Figure 7C:
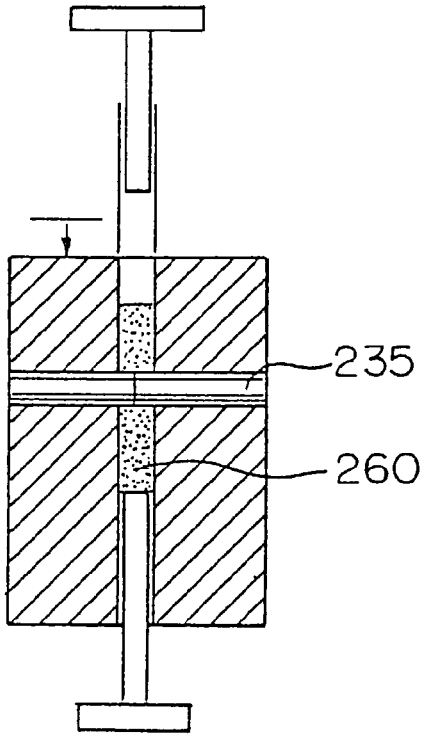

The step of positioning the metallurgical powder 260 about the core rod 235 may be comprised of centering the metallurgical powder 260 about the core rod 235, as illustrated in FIG. 7C.

Figure 7D:
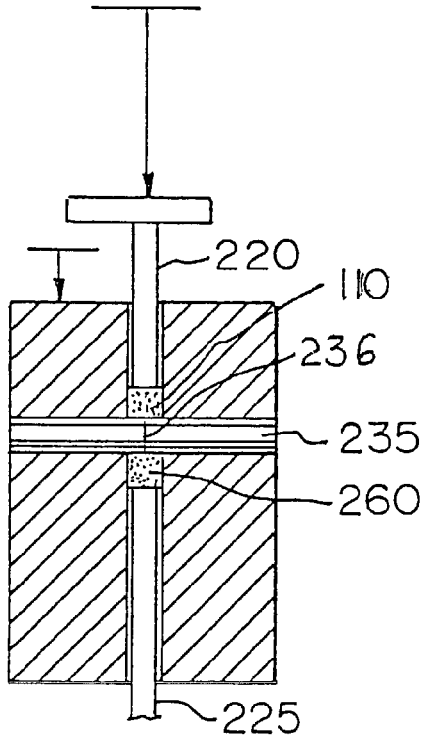

Directing attention to FIG. 7D, the top ram 220, is moved down and the bottom ram 225 is moved up against the metallurgical powder 260 to uniformly compress the metallurgical powder 260 about the core rod 235 to produce a green part 110 (FIG. 5). The top ram 220 and the bottom ram 225 may be moved equal distances or different distances to compress the green part 110, depending upon the circumstances. The green part 110 is formed to be sintered into a cutting insert 10. The process so far described utilizes a split core rod 235 comprised of a first segment 237 and a second segment 239 that meet within the cavity 210 of the die 205. When the powder 260 is compressed against the core rod 235, a discontinuity 236 at the point the first segment 237 and the second segment 239 meet will cause a parting line 135 (FIG. 5) to be imparted within the opening 125 of the green part 10. This feature is unique to cutting inserts produced using a uni-axial cross-hole press in accordance with the subject invention.

Figure 7E:
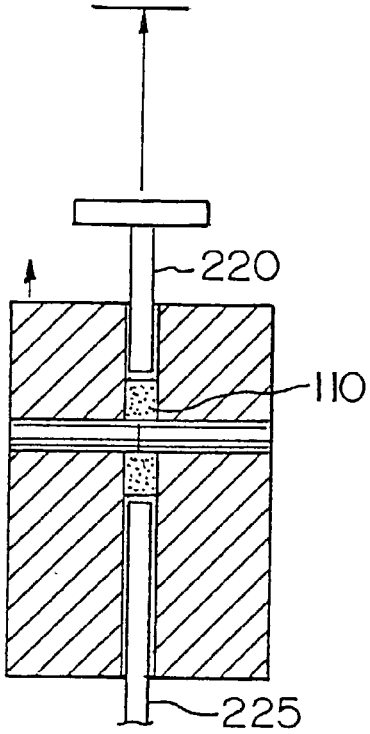

Once the metallurgical powder 260 is compressed, the top ram 220 and the bottom ram 225 are retracted, as illustrated in FIG. 7E, a predetermined amount to allow decompression of the green part 110.

Figure 7F:
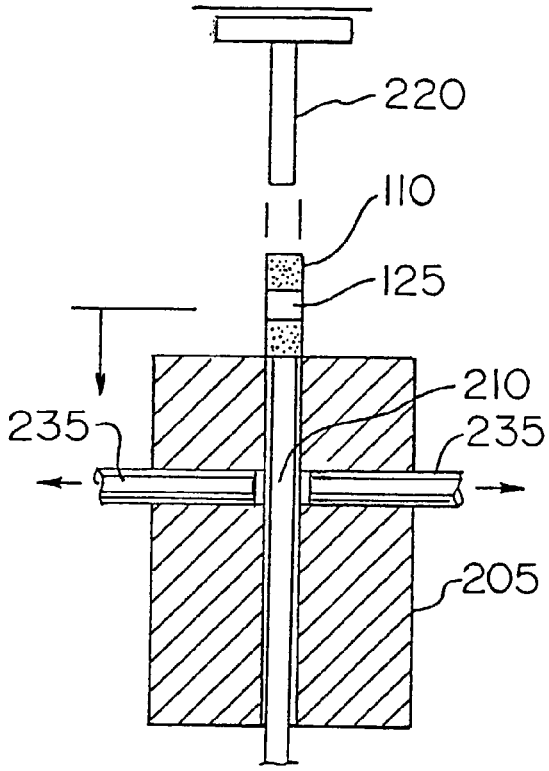

In FIG. 7F, the core rod 235 is retracted from within the cavity 210 such that the green part 110 is no longer held captive by the core rod 235 extending through the central opening 125. At this point, the green part 110 may be ejected from the die 205, as illustrated in FIG. 7F. In order to eject the green part 110 from the die 205, the top ram 220 is retracted completely from the cavity 210 and the bottom ram 225 is advanced until the green part 110 is ejected from the die 205. The top ram 220 and the bottom ram 225 may move simultaneously or they may move sequentially depending upon the desired operating conditions.

Figure 8:
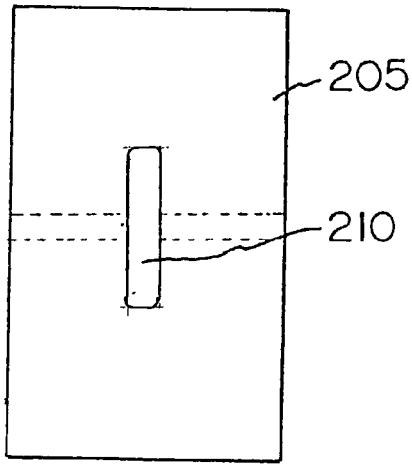
FIG. 8 is a view of the die along lines "VIII—VIII" in FIG. 7A.

FIG. 8 illustrates a top view of the die 205 along arrows "VIII—VIII" in FIG. 7A. It is apparent that the cavity 210 of the die 205 is rectangular, which is the shape of the green part 110 (FIG. 4) prior to decompression and sintering.

Figure 12:
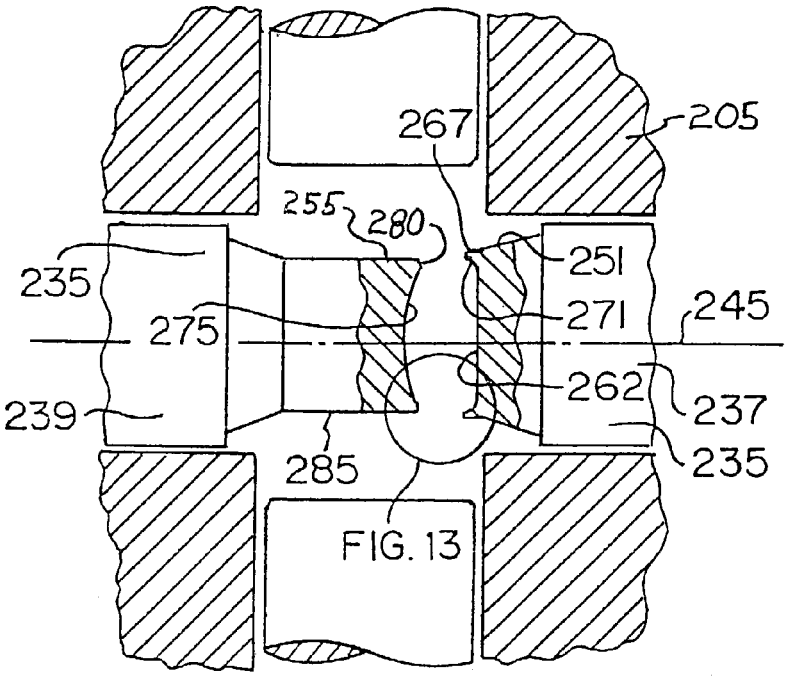
FIG. 12 is a cross-sectional view of the die illustrating the profile of the core rods in accordance with an alternate embodiment of the invention.

It should be noted that throughout these processes, the core rod 235 has been illustrated as a split type core rod 235 having two halves which meet within the cavity 210 to define the opening within the green part 110. Directing attention to FIG. 9, it is entirely possible for the removable core rod 235 to be of the split pin type, wherein the core rod 235 has a matable first segment 237 and second segment 239 and the step of positioning the removable core rod 235 through the core bore 240 into the cavity 210 is comprised of moving the matable first segment 237 into the cavity 210 from one side of the die 205, and moving the matable second segment 239 into cavity 210 from the other side of the die 205 causing the two segments to meet within the cavity 210. The matable segments 237, 239 of the core rod 235 are moved into the cavity 210 such that they may contact each other along the pressing axis 215 of the cavity 210. As illustrated in FIG. 12 and as will be discussed further, it is possible for the core rod segments 237, 239 to meet at a location other than along the pressing axis 215.

As previously mentioned, shrinkage during sintering of the green part 110 (FIG. 4) is not uniform across the cutting insert 10 (FIG. 1) and, as a result, the step of moving the top ram 220 down and the bottom ram 225 up to compress the metallurgical powder 260 is comprised of forming the central bore 125 (FIG. 5) of the green part 110 into a non-circular shape such that, when the green part 110 is sintered, the opening 125 will shrink a greater percentage along the pressing axis 215 (FIGS. 5 and 6) than in a direction perpendicular to the pressing axis 215. In a preferred embodiment, the non-circular shape 125 is an oval racetrack and the resulting sintered shape is a circle however it should be understood that the non-circular shape may be any number of different configurations depending upon the desired sintered shape.

The step of moving the top ram 220 down and the bottom ram 225 up to compress the metallurgical powder 260 may be further comprised of forming in at least one side 270 (FIG. 7A) of the powder bed 265 a counterbore 142 (FIG. 5) coaxial with the central opening 125. Additionally, the step of moving the top ram 220 down and the bottom ram 225 up to compress the metallurgical powder 260 may be comprised of imparting chip control features 150 to at least one edge 116 of the green part 110, as illustrated in FIG. 4. In one instance, the chip control features 150 may be comprised of a rake face 152 extending downwardly and away from the cutting edge 123 and a plateau wall 154 extending upwardly to a plateau 156 and away from the rake face 152 thereby defining an interrupted path that will promote chip control. To accomplish this, the top ram 220 and/or the bottom ram 225 must have a face with a profile complimentary to that of these chip control features or any other features 150 that may be imparted to the green part 110.

Finally, it should be appreciated that after the green part is formed, the part is intended to be sintered, whereby a cutting insert is produced.

While what has been discussed so far is a method of producing a green part that will be sintered into a cutting insert, the article formed by this process is also believed to be novel. Unlike other conventionally fabricated inserts, an insert fabricated in accordance with the subject invention will have a parting line within the wall of the central opening extending through the insert.

Figure 10:
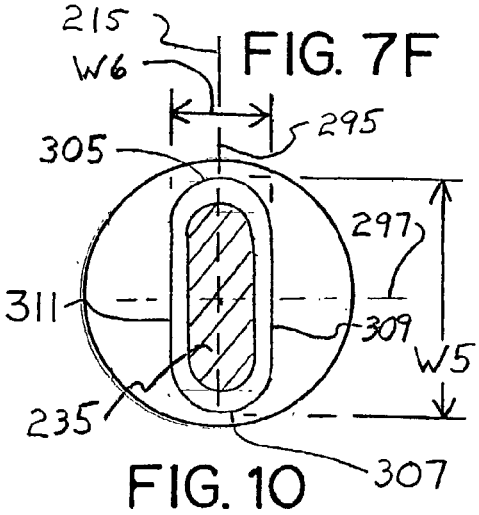
FIG. 10 is a cross-sectional view along the lines "X—X" in FIG. 9.
Figure 11:
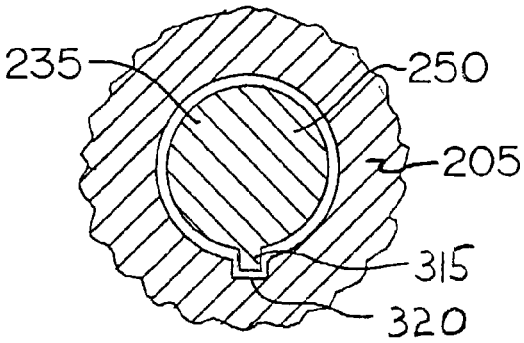
FIG. 11 is a cross-sectional view along lines "XI—XI" in FIG. 9.
Figure 9:
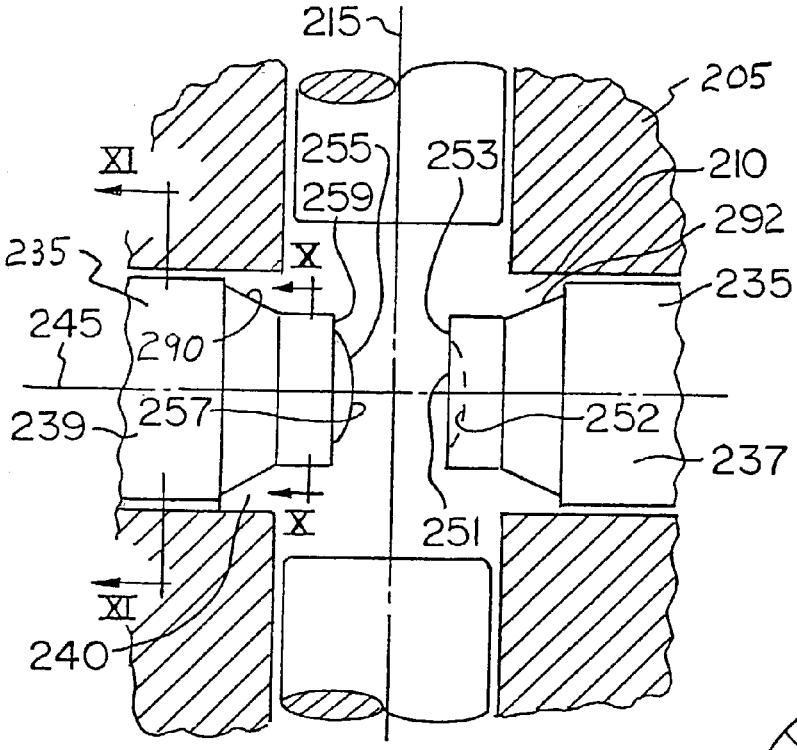
FIG. 9 is a cross-sectional view of the die illustrating the profile of the core rods in accordance with one embodiment of the subject invention.

An important feature of the subject invention is the design and operation of the core rod 235. FIG. 9 illustrates a split core rod 235 having a first segment 237 and a second segment 239 movable within the core bore 240 along the core bore longitudinal axis 245. The core rod 235 within the region of the cavity 210 has a cross-sectional configuration identical to the cross-sectional configuration of the central opening 125 illustrated in FIG. 5. This cross-sectional area, shown in FIG. 10, has a the shape of an oval and, more particularly, may be comprised of a first end 305 and a second end 307 having semi-circular shapes and connected by a first straight side 309 and second straight side 311 connecting therebetween. The core rod 235 has a major axis 295 parallel to the pressing axis 215 with a major width W5 thereacross and has a minor axis 297 perpendicular to the pressing axis 215 with a minor width W6 thereacross FIG. 11 illustrates a cross sectional view of the core rod 235 shown in FIG. 9 to show that the shaft 250 of the core rod 235 may have a key 315 which aligns with the channel 320 in the die 205 to properly orient the core rod 235 within the die 205.

Directing attention to FIG. 9, the first segment 237 and a second segment 239 each have complementary ends 251, 255 that meet to form a continuous core rod (not shown). End 251 of the first segment 237 has a curved indentation 252, while end 255 of the second segment 239 has a complementary curved projection 257 to mate with the indentation 252. The first segment 237 also has a peripheral planar ring 253 surrounding the indentation 252, while the second segment 239 has a complementary peripheral planar ring 259 surrounding the projection 257 such that the planar rings 253, 259 meet and contact one another.

Figure 13:
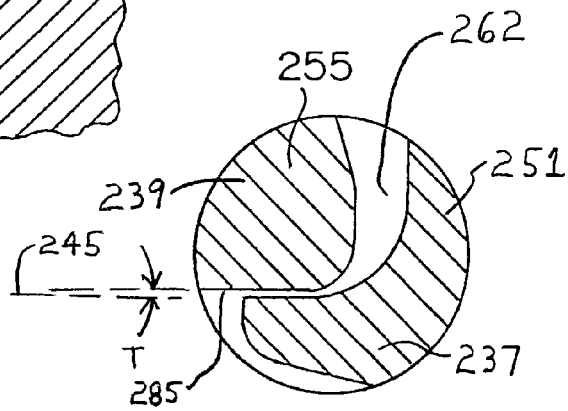
FIG. 13 is an enlarged view of the encircled area in FIG. 12 with the core rod parts in the closed position.

In an alternate embodiment, as illustrated in FIGS. 12 and 13, an end 251 of the core rod first segment 237 has a central cavity 262 surrounded by a wall 267 to define a cavity contour 271. End 255 of the core rod second segment 239 has a projection 280 in the shape of the cavity contour 271 but reduced such that the second segment 239 fits within the first segment 237. The end 251 of the first segment 237 may have a concave surface 275 to promote contact between the first segment 237 and the second segment 239.

FIG. 13 illustrates an enlarged section of the encircled area in FIG. 12 highlighting the manner in which the end 251 of the first segment 237 mates with the end 255 of the second segment 239. The projection 280 of the core rod second segment 239 has exterior walls 285 about a central axis 245 and the walls 285 have a taper T between 1–20° relative to the core rod longitudinal axis 245 to promote mating with the cavity 262 of the first segment 237.

While as discussed so far, the core rod 235 is comprised of two mating parts, it should be appreciated that it is entirely possible for the core rod 235 to be a single segment that may extend through the cavity 210. However, that there must be clearance available on the sides of the die 205 such that the core rod 235 may be retracted far enough to release the green part 110.

Returning to FIG. 1, the finished cutting insert 10 has a counterbore 42 which corresponds to the counterbore 142 of green part 110 in FIG. 5. The counterbore 142 was imparted to the green part 110 by a counterbore portion 290 (FIG. 9) corresponding to the shape of the counterbore 142 in the green part 110. In the event a counterbore is desired on both sides of the insert, an opposing counterbore portion 292 (FIG. 9) may be included on the opposite side of the core rod 235.

As mentioned, any article produced in accordance with the above invention utilizing a core rod 235 having two parts which contact one another within the cavity 210 will have a parting line 135, as illustrated in FIG. 4. It may be possible to remove this parting line 135 prior to sintering but, nevertheless, this parting line 135 exists as a result of the molding process. Furthermore, if the parting line 135 is not removed from the green part, then the parting line 35 (FIG. 1) will remain with the sintered article.

While specific embodiments of the invention have been described in detail, it will be appreciated by those skilled in the art that various modifications and alternatives to those details could be developed in light of the overall teachings of the disclosure. The presently preferred embodiments described herein are meant to be illustrative only and not limiting as to the scope of the invention which is to be given the full breadth of the appended claims and any and all equivalents thereof.

What is claimed is:

1. A method of fabricating an article having an opening using a press with a uni-axial press motion, wherein the article is intended to be sintered and wherein the press has a die with a cavity extending therethrough along a pressing axis with a top ram and a bottom ram independently movable along the pressing axis within the cavity to define a compression region and furthermore having a removable core rod insertable within a core bore through the cavity at the compression region in a direction perpendicular to the pressing axis, wherein the method comprises the steps of:

a) positioning the bottom ram within the cavity below the core bore and positioning the top ram outside of the cavity;

b) positioning the removable core rod through the core bore such that the core rod extends completely through the cavity;

c) filling the cavity with a predetermined amount of metallurgical powder to form a powder bed having opposing sides;

d) moving the die cavity relative to the top ram and the bottom ram to substantially uniformly distribute the powder within the cavity;

e) positioning the metallurgical powder about the core rod to control the location of the opening after sintering;

f) moving the top ram down and moving the bottom ram up against the metallurgical powder along the pressing axis to uniformly compress the metallurgical powder about the core rod to produce a green part, wherein the green part has a top and bottom and sides therebetween and the green part has a major axis parallel to the pressing axis with a major width thereacross and also has a minor axis perpendicular to the pressing axis with a minor width thereacross;

g) retracting the top ram and the bottom ram a predetermined amount to allow decompression of the green part;

h) retracting the core rod from within the cavity; and i) ejecting the green part from the die.

2. The method according to claim 1 wherein the step of positioning the removable core rod through the core bore into the cavity is comprised of moving the matable first segment into the cavity from one side of the die and the matable second segment into the cavity from the other side of the die causing the two segments to meet within the cavity.

3. The method according to claim 2 wherein the mateable segments of the core rod are moved into the cavity such that they contact each other along the pressing axis of the cavity.

4. The method according to claim 1 wherein the step of moving the die relative to the top ram and the bottom ram to substantially uniformly distribute the powder within the cavity comprises moving the die up and down relative to the top ram and the bottom ram.

5. The method according to claim 1 wherein the step of positioning the metallurgical powder about the core rod is comprised of centering the metallurgical powder about the core rod.

6. The method according to claim 1 wherein the step of moving the top ram down and the bottom ram up is comprised of moving the top ram down and the bottom ram up by an equal amount.

7. The method according to claim 1 wherein the step of ejecting the green part from the die is comprised of retracting the top ram completely from the cavity and advancing the bottom ram until the green part is ejected from the die.

8. The method according to claim 7 wherein the top ram and the bottom ram move simultaneously.

9. The method according to claim 7 wherein the top ram and the bottom ram move sequentially.

10. The method according to claim 1 wherein the step of moving the top ram down and the bottom ram up to compress the powder is comprised of forming the opening of the green part into a non-circular shape such that when the green part is sintered the opening will shrink a greater percentage in a direction parallel to the pressing axis than in a direction perpendicular to the pressing axis.

11. The method according to claim 10 wherein the green part has a major width along a major axis parallel to the pressing axis and has a minor width along a minor axis perpendicular to the pressing axis such that when sintered the green part will shrink and the opening will deform to a predetermined final shape.

12. The method according to claim 11 wherein the non-circular shape is an oval racetrack having two opposing straight segments parallel to the pressing axis and two opposing semi-circles connecting the ends of the straight segments.

13. The method according to claim 10 wherein the non-circular shape, after sintering, shrinks into a circular shape.

14. The method according to claim 1 wherein the step of moving the top ram down and the bottom ram up to compress the powder is further comprised of forming in at least one side of the powder bed a counterbore co-axial with the opening.

15. The method according to claim 1 wherein the green part is formed to be sintered into a cutting insert and wherein the step of moving the top ram down and the bottom ram up to compress the powder is further comprised of imparting chip control features to at least one of the top or the bottom of the green part.

16. The method according to claim 15 wherein the chip control feature is comprised of a rake face extending downwardly and away from a cutting edge and a plateau wall extending upwardly and away from the rake face thereby defining an interrupted path that will promote chip control.

17. The method according to claim 1 further including the step of sintering the green part to form a cutting insert.

18. A uni-axial press for forming a green part from compressed metallurgical powder, wherein the press comprises:

a) a die with a cavity extending therethrough along a pressing axis with a top ram and a bottom ram independently movable along the pressing axis within the cavity to define a compression region, and b) a removable core rod insertable to define a core bore at the compression region in a direction perpendicular to the pressing axis, wherein the core rod is adapted to extend completely through the cavity;

1) wherein the core rod has a longitudinal axis and comprises a shaft having a non-circular cross-section to impart a non-circular opening within the green part for accommodating shrinkage of the opening, and 2) wherein the core rod is comprised of a first segment having an end with an indentation and a second segment having an end with a tapered protrusion, wherein the protrusion axially contacts and engages the indentation to form a continuous core rod.

19. The uni-axial press according to claim 18 wherein the core rod has a cross-sectional shape with a major axis parallel to the pressing axis and a major width thereacross and with a minor axis perpendicular to the pressing axis with a minor width thereacross.

20. The uni-axial press according to claim 19 wherein the core rod has a cross-sectional shape of an oval having two straight sides connected by semi-circular ends and wherein the straight sides are parallel to the major axis of the core rod.

21. The urn-axial press according to claim 20 wherein the straight sides of the core rod are aligned such that they are parallel to the pressing axis.

22. The urn-axial press according to claim 18 wherein the ends of the first segment and the second segment engage one another at the center of the die cavity.

23. The uni-axial press according to claim 18 wherein the first segment has an end with a curved indentation and the second segment has an end with a complimentary curved projection to mate with the indentation.

24. The uni-axial press according to claim 23 wherein the first segment has a peripheral planar ring surrounding the indentation and the second segment has a complimentary peripheral planar ring surrounding the projection such that the planar rings meet to contact one another.

25. The urn-axial press according to claim 18 wherein the core rod is a single segment that may extend through the cavity.

26. The uni-axial press according to claim 18 wherein a portion of the rod has an enlarged segment to impart a counterbore within the side of the green part.

27. The uni-axial press according to claim 18 wherein the shaft of the core rod is keyed along the longitudinal axis within the die to properly orient the core rod within the die.

28. A method of fabricating an article having an opening using a press with a uni-axial press motion, wherein the article is intended to be sintered and wherein the press has a die with a cavity extending therethrough along a pressing axis with a top ram and a bottom ram independently movable along the pressing axis within the cavity to define a compression region and furthermore having a removable core rod insertable within a core bore through the cavity at the compression region in a direction perpendicular to the pressing axis, wherein the method comprises the steps of:

a) positioning the bottom ram within the cavity below the core bore and positioning the top ram outside of the cavity;

b) positioning the removable core rod through the core bore such the core rod extends completely through the cavity;

c) filling the cavity with a predetermined amount of metallurgical powder to form a powder bed having opposing sides;

d) moving the die cavity relative to the top ram and the bottom ram to position the metallurgical powder about the core rod to control the location of the opening after sintering;

e) moving the top ram down and moving the bottom ram up against the metallurgical powder along the pressing axis to uniformly compress the metallurgical powder about the core rod to produce a green part, wherein the green part has a top and bottom and sides therebetween and the green part has a major axis parallel to the pressing axis with a major width thereacross and also has a minor axis perpendicular to the pressing axis with a minor width thereacross, wherein the step of moving the top ram down and the bottom ram up to compress the powder is further comprised of imparting chip control features to at least one of the top or the bottom of the green part and wherein the green part is formed to be sintered into a cutting insert;

f) retracting the top ram and the bottom ram a predetermined amount to allow decompression of the green part;

g) retracting the core rod from within the cavity; and h) ejecting the green part from the die.

29. A method of fabricating an article having an opening using a press with a uni-axial press motion, wherein the article is intended to be sintered and wherein the press has a die with a cavity extending therethrough along a pressing axis with a top ram and a bottom ram independently movable along the pressing axis within the cavity to define a compression region and furthermore having a removable core rod insertable within a core bore through the cavity at the compression region in a direction perpendicular to the pressing axis, wherein the method comprises the steps of:

a) positioning the bottom ram within the cavity below the core bore and positioning the top ram outside of the cavity;

b) positioning the removable core rod through the core bore such that the core rod extends completely through the cavity;

c) filling the cavity with a predetermined amount of metallurgical powder to form a powder bed having opposing sides;

d) positioning the metallurgical powder about the core rod to control the location of the opening after sintering;

e) moving the top ram down and moving the bottom ram up against the metallurgical powder along the pressing axis to uniformly compress the metallurgical powder about the core rod to produce a green part, wherein the green part has a top and bottom and sides therebetween and the green part has a major axis parallel to the pressing axis with a major width thereacross and also has a minor axis perpendicular to the pressing axis with a minor width thereacross and is formed to be sintered into a cutting insert;

f) retracting the top ram and the bottom ram a predetermined amount to allow decompression of the green part;

g) retracting the core rod from within the cavity;

h) ejecting the green part from the die; and i) wherein the step of moving the top ram down and the bottom ram up to compress the powder is further comprised of forming the opening of the green part into a non-circular shape such that the shape, during sintering, shrinks into a predetermined shape different than the non-circular shape.

30. The method according to claim 29, wherein the step of moving the top ram down and the bottom ram up to compress the powder is comprised of forming the opening of the green part into the shape of an oval racetrack having two opposing straight segments parallel to the pressing axis and two opposing semi-circles connecting the ends of the straight segments, such that the shape, after sintering, is deformed into a circle.

* * * * *